United States Patent [19]

Kawashima

[11] Patent Number: 4,557,060

[45] Date of Patent: Dec. 10, 1985

[54] INSOLE WITH EXCHANGEABLE RELIANT PIECES

[75] Inventor: Yukio Kawashima, Akashi, Japan

[73] Assignee: Mizuno Corporation, Osaka, Japan

[21] Appl. No.: 507,452

[22] Filed: Jun. 24, 1983

[30] Foreign Application Priority Data

Jun. 26, 1982 [JP] Japan ..... 57-96410

[51] Int. Cl.[4] ..... A43B 13/38

[52] U.S. Cl. ..... 36/44; 36/30 R

[58] Field of Search ..... 36/43, 44, 88, 95, 129, 36/96, 92, 30 A, 28

[56] References Cited

U.S. PATENT DOCUMENTS

| | | | |
|---|---|---|---|
| 1,741,419 | 12/1929 | Jones | 36/43 X |
| 1,907,136 | 5/1933 | Weitsen | 36/43 X |
| 2,046,732 | 7/1936 | Fein | 36/43 |
| 2,088,902 | 8/1937 | Fein | 36/43 |
| 2,928,193 | 3/1960 | Kristan | 36/44 X |
| 3,594,929 | 7/1971 | Stohr | 36/44 |
| 4,364,188 | 12/1982 | Turner et al. | 36/129 X |
| 4,408,402 | 10/1983 | Looney | 36/43 |

*Primary Examiner*—Werner H. Schroeder
*Assistant Examiner*—T. Graveline
*Attorney, Agent, or Firm*—Fleit, Jacobson, Cohn & Price

[57] ABSTRACT

An insole for a sports shoe comprises an insole body of foam synthetic resin having recesses formed therein at the forefoot and heel areas. Corresponding pieces are of material having higher durometer hardness than that of the insole body and inserted in the recesses to provide good properties required for various kinds of sports.

4 Claims, 5 Drawing Figures

INSOLE WITH EXCHANGEABLE RELIANT PIECES

This invention relates to an insole suitable mainly for use in sports shoes and including the forefoot and heel areas having shock absorption selected to suit the kind of sports, the body weight and so on, thereby reducing fatigue and providing excellent wearing comfort, as well as preventing the insole from loosing elasticity.

Generally, an insole is laid on the midsole of a shoe so as to prevent the midsole from being stained with sweat and grease of the foot, thereby keeping the inside of the shoe clean, as well as to provide proper cushioning. In sports shoes as well, a soft insole of foam synthetic resin or of a similar material is sometimes used. However the insole of the single kind is not necessarily suitable for use in all kinds of sports shoes having different quality, function and construction required for many kinds of sports, such as golf shoes, baseball shoes, running shoes and so on.

Thus, the insoles having different quality and function may be required to the shoes for different sports to promote the function of the sport shoes. However, in order to satisfy such a requirement, various kinds of insoles should be produced. Therefore, a main object of the present invention is to provide an insole adapted to suit any sports by providing forefoot and heel areas having adequate shock absorption depending on the kind of sport.

According to this invention, each of the forefoot and heel areas may comprise an exchangeable piece of resilient foam synthetic resin having higher durometer hardness than that of an insole body and inserted in a recess formed in the insole body.

The other objects and advantages of the present invention will become apparent from the following description on, preferred embodiments thereof with reference to the accompanying drawings.

Figure 1:
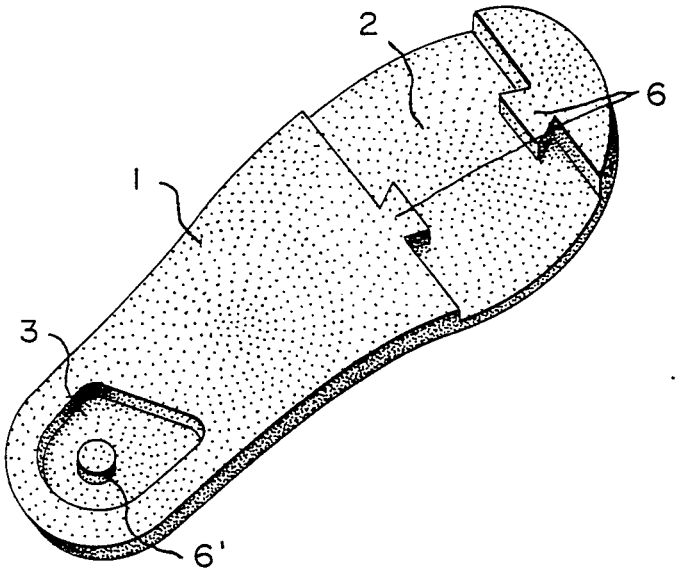
FIG. 1 is a perspective view of a body of an insole according to the present invention.
Figure 2:
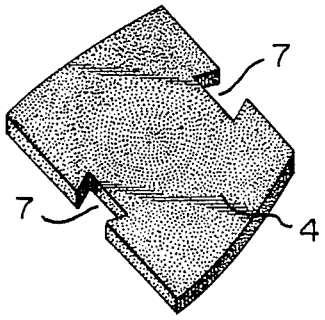
FIG. 2 is a perspective view of a forefoot resilient piece.
Figure 3:
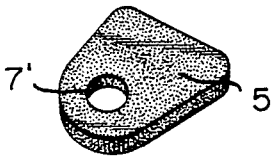
FIG. 3 is a perspective view of a heel resilient piece.

Referring to FIGS. 1 through 3 of the drawings, there is provided an insole comprising a molded insole body 1 of thermoplastic or thermosetting foam synthetic resin, having recesses 2 and 3 of desired shapes formed at the forefoot area and heel area on one side thereof. Corresponding exchangable resilient pieces 4 and 5 have a thickness corresponding to the depth of the recesses 2 and 3 and are of a material different in elasticity and durometer hardness from that of the insole body. The resilient pieces 4 and 5 are inserted in the recesses 2 and 3, respectively to flush with the surface of the insole body 1. Several pairs of resilient pieces 4 and 5 are provided for the single insole and each has different elasticity and hardness, e.g., hard (60C of the durometer hardness), medium (45C) and soft (30C).

Preferably, projections 6 in the form of wedges are formed on the recess 2 at its edges and a projection 6' in the form of a post is formed on the recess 3 at its center. The pieces 4 and 5 have notches 7 and a hole 7' formed therein respectively, which frictionally engage said projections 6 and 6' to firmly fit the pieces 4 and 5 in the recesses 2 and 3.

In use of the insole of this invention, a pair of resilient pieces 4 and 5 of proper elasticity and hardness is selected for insertion into the recesses 2 and 3 to suit the kind of sport, and user's body weight.

In a shoe for baseball, soccer, field and track events and the like where running at full speed and a strong kick are required, the shock of foot strike will apparently be great. Therefore, pieces 4 and 5 having high elasticity (hard) should be inserted into the recesses 2 and 3 of the insole 1 to promote the function of the shoe by resisting the foot pressure and providing good shock absorption and high kick force. On the other hand, in a golf shoe and mountain climing shoe where, although running at full speed is not involved, long and exhausting walking is required, the pieces 4 and 5 having medium elasticity and hardness are inserted into the recesses 2 and 3. This arrangement will have increased cushioning. As a result, good wearing comfort of the shoe is provided and fatigue of the foot is reduced. In shoes for jump, soft pieces 4 and 5 are used to increase the power to jump. Furthermore, depending on the user's body weight, pieces 4 and 5 of appropriate elasticity and hardness can be selected to obtain the wearing comfort that suits the taste of the user.

Figure 4:
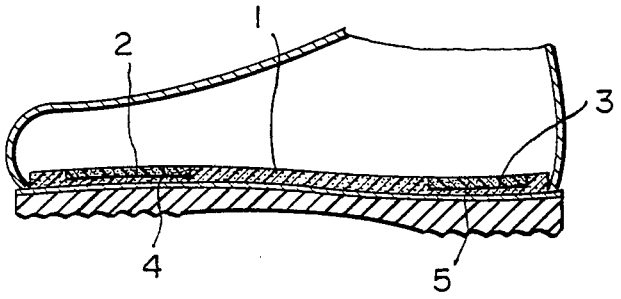
FIG. 4 is a side elevational view of a shoe shown in cross-section, with the insole with the forefoot and heel pieces laid on the midsole thereof.
Figure 5:
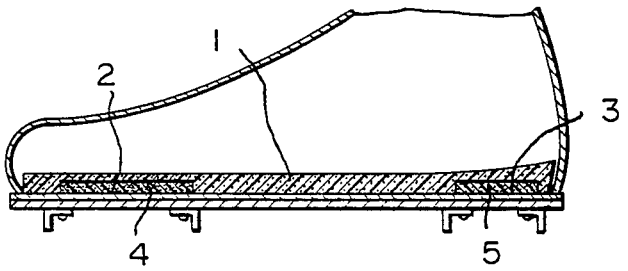
FIG. 5 is a view similar to FIG. 4, but showing the insole inserted in the shoe in a reversed position.

As shown in FIGS. 4 and 5, the insole of the present invention may be laid on the midsole of a shoe with the pieces 2 and 3 faced upward or downward in accordance with the taste of the user.

As described above, the insole of this invention can be used in various sport shoes in combination with pieces 4 and 5 which are made of a material different from that of the insole in elasticity and hardness to promote the essential function of the shoe for particular sports.

I claim:

1. An insole for a shoe, said insole comprising:

a body made of one of thermoplastic and thermosetting foam synthetic resin, said body including a heel area and a forefoot area having a top surface and a bottom surface, two recesses defined by said body located on one of the top surface and the bottom surface of said body, one of said two recesses being located at said heel area of said body and being spaced from the sides of said body, the other of said two recesses being located at a forefoot area of said body and extending laterally to opposed side edges of said body, two reslient members having a different durometer hardness than that of said body, said two resilient members being complementary in shape to said two recesses for frictionally engaging said two recesses, and said body includes a projection spaced from the peripheral edge of said one of said two recesses and projecting into said one recess, the resilient member complementary in shape to said one of said two recesses defines a hole frictionally engaging said projection, said body also includes two wedges, each wedge extending from opposed lateral edges of said other of said two recesses and the resilient member complementary in shape to said other of said two recesses defining two notches frictionally engaging said two wedges.

2. An insole as described in claim 1, wherein said two resilient members are one of several pairs of resilient members, each pair of resilient members having different elasticity and hardness than another pair of resilient members for changing the properties of the insole according to its use.

3. An insole as described in claim 1, wherein said body includes a projection spaced from the peripheral edge of said one recess and projecting into said one recess, the resilient member complementary in shape to said one recess defining a hole frictionally engaging said projection.

4. An insole as described in claim 1, wherein said body includes two wedges, each wedge extending from opposed lateral edges of said other recess and the resilient member complementary in shape to said other recess defining two notches frictionally engaging said two wedges.

* * * * *